US007927150B2

(12) United States Patent
Ratzlaff

(10) Patent No.: US 7,927,150 B2
(45) Date of Patent: Apr. 19, 2011

(54) CONNECTORS INCLUDING SPRING TABS FOR HOLDING A CONTACT MODULE

(75) Inventor: Thomas D. Ratzlaff, Menlo Park, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 71 days.

(21) Appl. No.: 12/257,132

(22) Filed: Oct. 23, 2008

(65) Prior Publication Data

US 2010/0105252 A1 Apr. 29, 2010

(51) Int. Cl.
*H01R 25/00* (2006.01)

(52) U.S. Cl. ..... 439/655

(58) Field of Classification Search ..... 439/655, 439/607.46, 473, 345, 357
See application file for complete search history.

(56) References Cited

U.S. PATENT DOCUMENTS

| | | | | |
|---|---|---|---|---|
| 2,750,571 | A | 6/1956 | Schmier | |
| 3,671,921 | A | 6/1972 | Baker et al. | |
| 4,526,435 | A | 7/1985 | Borne et al. | |
| 4,657,331 | A | 4/1987 | Coldren | |
| 4,764,130 | A | 8/1988 | DiClemente | |
| 4,960,387 | A | 10/1990 | Davis et al. | |
| 4,986,769 | A | 1/1991 | Adams, III et al. | |
| 5,073,127 | A * | 12/1991 | Daly et al. | 439/473 |
| 5,244,415 | A | 9/1993 | Marsilio et al. | |
| 5,282,757 | A | 2/1994 | Maeda | |
| 5,431,577 | A | 7/1995 | Lincoln | |
| 5,480,329 | A | 1/1996 | Karlstroem et al. | |
| 5,613,881 | A | 3/1997 | Ichida et al. | |
| 5,890,931 | A | 4/1999 | Ittah et al. | |
| 6,247,978 | B1 | 6/2001 | Wu | |
| 6,354,878 | B1 | 3/2002 | Kropa et al. | |
| 6,416,346 | B1 | 7/2002 | Nakamura | |
| 6,478,631 | B1 | 11/2002 | Dutton et al. | |
| 6,524,135 | B1 * | 2/2003 | Feldman et al. | 439/607.46 |
| 6,840,789 | B2 * | 1/2005 | Shibata | 439/345 |
| D523,399 | S | 6/2006 | Sakamaki et al. | |
| 7,059,892 | B1 | 6/2006 | Trout | |
| 7,137,848 | B1 | 11/2006 | Trout et al. | |
| 7,294,010 | B1 | 11/2007 | Shaikh | |
| 7,300,317 | B2 | 11/2007 | Dillon et al. | |
| 7,303,438 | B2 | 12/2007 | Dawiedczyk et al. | |
| 7,318,757 | B1 | 1/2008 | Minich | |

(Continued)

FOREIGN PATENT DOCUMENTS

DE 9312131 U1 2/1994

(Continued)

OTHER PUBLICATIONS

International Search Report for International Application No. PCT/US2009/005736, mailed Mar. 18, 2010.

(Continued)

*Primary Examiner* — Jean F Duverne

(57) ABSTRACT

A connector configured to hold a contact module. The connector includes a housing that has an interior surface defining a cavity that extends between first and second ends of the housing. The cavity is configured to receive and hold the contact module therein. The connector also includes a spring tab that is located in the cavity and oriented to project from the interior surface toward the first end of the housing. The spring tab is integrally formed with the housing. Also, the connector includes a ridge portion that is located in the cavity and oriented to project from the interior surface. The contact module is retained between the ridge portion and the spring tab.

18 Claims, 7 Drawing Sheets

U.S. PATENT DOCUMENTS

| | | | |
|---|---|---|---|
| 2001/0016457 | A1 | 8/2001 | Taguchi et al. |
| 2005/0118883 | A1 | 6/2005 | Kim |

FOREIGN PATENT DOCUMENTS

| | | | |
|---|---|---|---|
| DE | 19813458 | A1 | 10/1998 |
| EP | 1049214 | A1 | 11/2000 |
| GB | 2133638 | A | 7/1984 |
| GB | 2134724 | A | 8/1984 |
| GB | 2384630 | A | 7/2003 |
| WO | WO-87/07088 | A1 | 11/1987 |
| WO | WO-99/62145 | A1 | 12/1999 |
| WO | WO-2008/091253 | A1 | 7/2008 |

OTHER PUBLICATIONS

International Search Report for International Application No. PCT/US2009/005755, mailed Dec. 30, 2009.

International Search Report for International Application No. PCT/US2009/005735, mailed Jan. 25, 2010.

International Search Report for International Application No. PCT/US2009/005766, mailed Jan. 7, 2010.

* cited by examiner

CONNECTORS INCLUDING SPRING TABS FOR HOLDING A CONTACT MODULE

CROSS-REFERENCES TO RELATED APPLICATION

The present application includes subject matter related to subject matter disclosed in U.S. patent applications Nos. 12/257,107, 12/257,166 (now U.S. Pat. No. 7,544,084), and Ser. No. 12/257,187, which were filed contemporaneously with this application, which are all incorporated by reference in their entirety.

BACKGROUND OF THE INVENTION

The subject matter herein relates generally to electrical and/or optical connectors, and more particularly, to connectors configured to hold a contact module within a housing.

Connector and connector assemblies provide interconnects between components where power and/or signals may be transmitted therebetween. For example, connectors may be used within aircraft harnesses, avionics boxes, telecommunication equipment, servers, and data storage or transport devices. Some known connector assemblies include plug and receptacle connectors where at least one of the connectors includes a contact module for holding one or more mating contacts. The contact module is typically held within a housing by using different features or mechanisms. For example, some methods for securing the contact module within the housing include using adhesives, retention clips, or other retention hard ware.

U.S. Pat. Nos. 6,478,631 and 4,764,130 disclose electrical connectors that each have a housing constructed from two half shells configured to hold a contact module therebetween. These patents describe the insertion of a retention clip through each half shell in order to hold the contact module in the proper operating position between the two half shells. The retention clips extend into the cavity and engage each side of the contact module therein. The half shells are permanently riveted together thereby entrapping each retention clip into position between the contact module and corresponding shell. Although the connectors are able to hold the contact module within the cavity, using separate retention clips to hold the contact module within the housing can increase the cost, time of manufacturing, and the possibility of inadvertently damaging the components of the connector during assembly.

Accordingly, there is a need for a connector where the components of the connector are coupled together using fewer pieces of hardware than known connectors and/or using fewer assembly steps. There is also a need for alternative mechanisms and methods for assembling a connector.

BRIEF DESCRIPTION OF THE INVENTION

In one embodiment, a connector configured to hold a contact module is provided. The connector includes a housing that has an interior surface defining a cavity that extends between first and second ends of the housing. The cavity is configured to receive and hold the contact module therein. The connector also includes a spring tab that is located in the cavity and oriented to project from the interior surface toward the first end of the housing. The spring tab is integrally formed with the housing. Also, the connector includes a ridge portion that is located in the cavity and oriented to project from the interior surface. The contact module is retained between the ridge portion and the spring tab.

Optionally, the housing is at least partially formed from a material such as polyaryletherketone (PAEK). The integrated spring tab may have a base portion that extends from the interior surface and a tab body that extends therefrom. The base portion of the spring tab may have a width that is substantially greater than a thickness of the tab body. Furthermore, the spring tab may be configured to flex toward the interior surface when the contact module is being inserted and flex away from the interior surface into a locked position against the contact module into its operating position.

In another embodiment, a connector is provided that includes a contact module that is configured to hold at least one mating contact connected to a corresponding conductor or cable. The connector also includes a housing that has an interior surface defining a cavity that extends between first and second ends of the housing. The cavity is configured to receive and hold the contact module therein. The connector also includes a spring tab that is located in the cavity and oriented to project from the interior surface toward the first end of the housing. The spring tab is integrally formed with the housing. Also, the connector includes a ridge portion that is located in the cavity and oriented to project from the interior surface. The contact module is retained between the ridge portion and the spring tab.

The connector may be, for example, a receptacle connector or a plug connector. Furthermore, the conductors and/or cables may be used to transmit electrical signals and/or power, or the conductors and/or cables may be used for transmitting signals in fiber-optic communication.

DETAILED DESCRIPTION OF THE INVENTION

Figure 1:
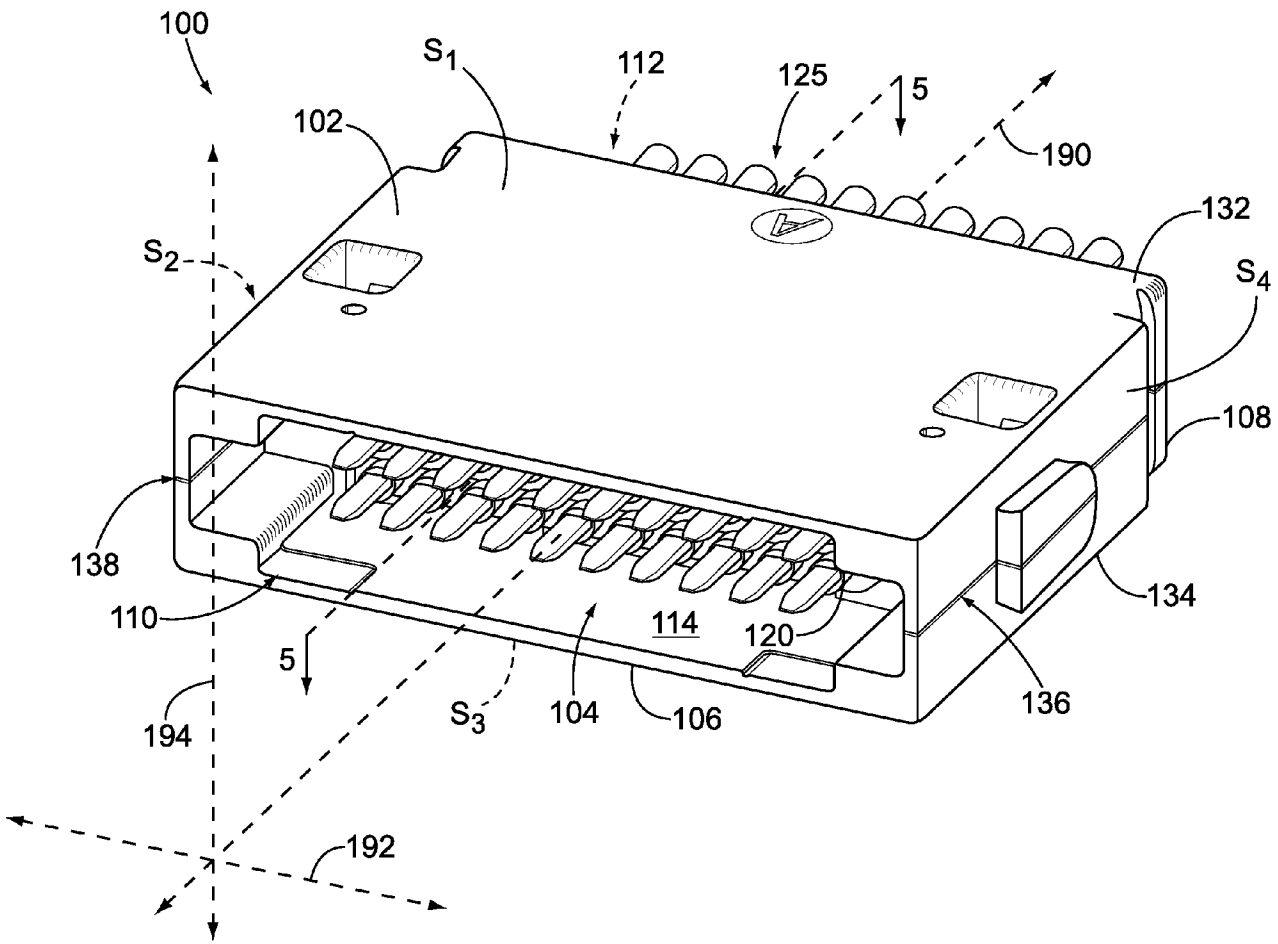
FIG. 1 is a perspective view of a receptacle connector formed in accordance with one embodiment.

FIG. 1 is a perspective view of a receptacle connector 100 formed in accordance with one embodiment. The receptacle connector 100 includes a housing 102 having a mating end 106 and a loading end 108 with a cavity 104 extending therebetween. The cavity 104 is defined by an interior surface 114 and is configured to receive and hold a contact module 120 therein. As will be discussed in greater detail below, the housing 102 includes integral features that may allow the receptacle connector 100 to be assembled in fewer steps and/or at a reduced cost as compared to known connectors. In the illustrated embodiment, the receptacle connector 100 is an electrical connector that communicatively couples conductors and/or cables 125 to a plug connector (not shown). However, embodiments described herein are not limited to electrical connectors, but may also be connectors that interconnect optical fibers or optoelectronic connectors. As such, the phrase "conductors and/or cables" or the phrase "at least one of conductors and cables" includes electrical wires, conductors, or cables that transmit electrical signals or power or electrical signals and power, as well as optical fibers or cables used for transmitting signals in fiber-optic communication.

Furthermore, although FIG. 1 illustrates a receptacle connector 100 having a housing 102 with a contact module 120 therein, alternative embodiments may include plug or other receptacle connectors having a variety of shaped housings. Furthermore, the contact module 120 may have mating contacts that are pin contacts as shown in FIG. 1, or, alternatively, socket contacts embedded within, e.g., socket cavities of a contact module. The mating contacts may be electrical contacts or termini for optical fibers. As such, embodiments as described herein may have a variety of shapes and purposes and may be a variety of types of connectors.

The receptacle connectors 100 may be constructed by a variety of methods and may include various accessories attached thereto such as those methods and accessories described in U.S. patent application No. 12/257,187, which is incorporated by reference in its entirety. In addition, the receptacle connector 100 may be constructed by two or more shells that are held together as described in U.S. patent application Ser. No. 12/257,166 (now U.S. Pat. No. 7,544,084), which is incorporated by reference in its entirety. Also, the receptacle connector 100 may be configured to prevent damaging the contacts when the receptacle connector 100 is mated with a complementary connector, such as the plug and receptacle connectors described in U.S. patent application Ser. No. 12/257,107), which is incorporated by reference in its entirety.

In the illustrated embodiment, the housing 102 is substantially rectangular and is oriented with respect to a central axis 190, a longitudinal axis 192, and a lateral axis 194. The housing 102 may be assembled from separate parts (e.g., shells 132 and 134) or, alternatively, may be molded/formed as one piece. The housing 102 includes a plurality of sides $S_1$-$S_4$ that extend substantially parallel to the central axis 190 in a front-to-back direction between the mating and loading ends 106 and 108. The sides $S_1$ and $S_3$ are longitudinal sides that may extend parallel to a plane formed by the longitudinal and central axes 192 and 190, and the sides $S_2$ and $S_4$ are lateral sides that may extend parallel to a plane formed by the lateral and central axes 194 and 190.

As shown, the cavity 104 extends between the mating and loading ends 106 and 108 along the central axis 190. The housing 102 includes an opening 110 leading into the cavity 104 at the mating end 106 and an opening 112 leading into the cavity 104 at the loading end 108. Although FIG. 1 illustrates the cavity 104 extending completely through the housing 102 between the openings 110 and 112, the cavity 104 may be partially or completely closed off at the mating and loading ends 106 and 108. Furthermore, the cavity 104 is not required to extend axially through the housing 102, but may form, for example, a 90° angle between openings of the cavity such that the receptacle connector 100 is a right-angle connector.

Figure 2:
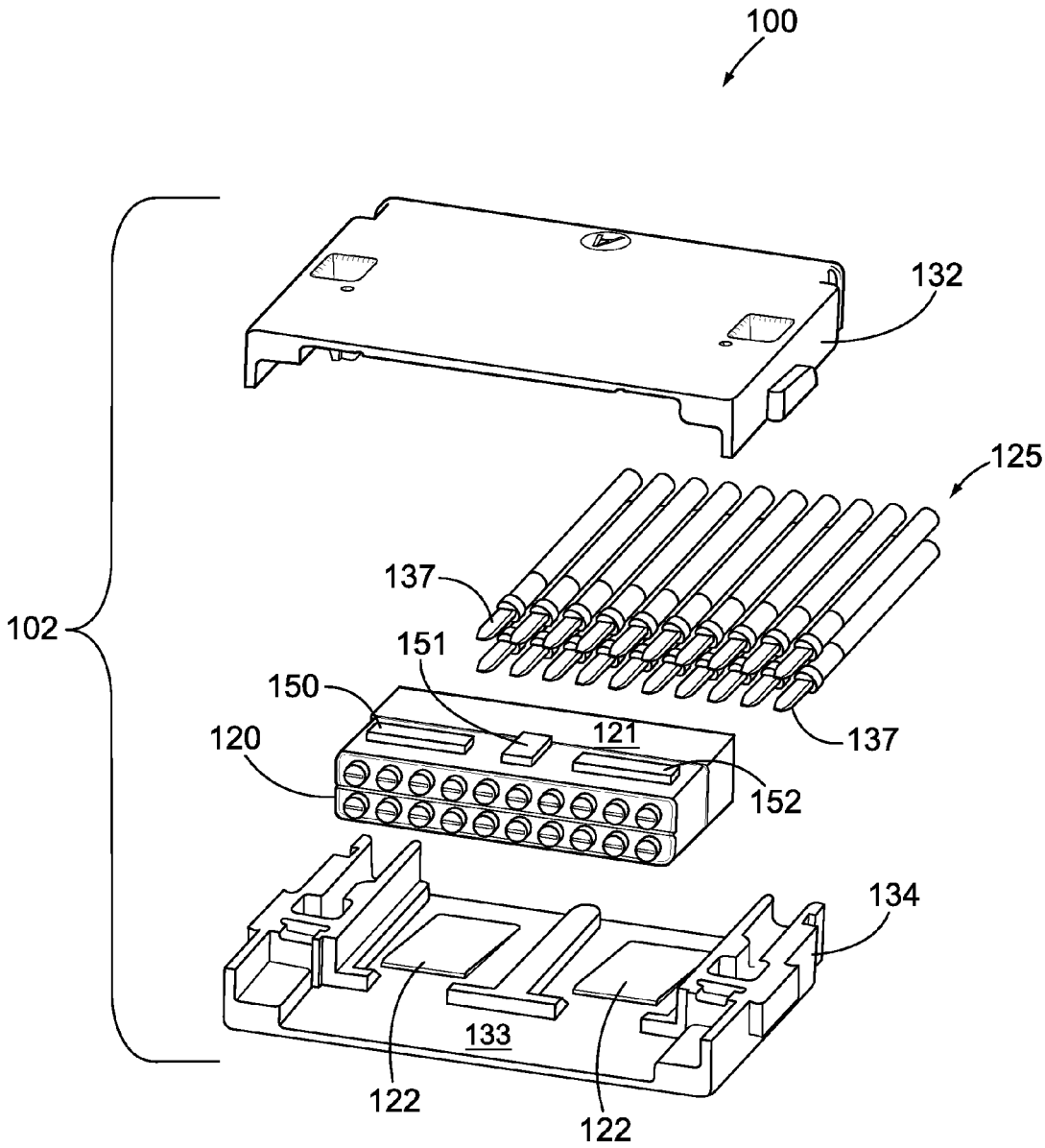
FIG. 2 is an exploded view of the receptacle connector shown in FIG. 1.

FIG. 2 is an exploded view of the receptacle connector 100. As discussed above, in some embodiments, the housing 102 is constructed from two separate shells 132 and 134. The housing shells 132 and 134 may be mated together along interfaces 136 and 138 (shown in FIG. 1). The housing shells 132 and 134 may be identical or may be formed to have different features. Each shell 132 and 134 includes an inner surface 133 and 135 (shown in FIG. 4), respectively, that collectively form the interior surface 114 (FIG. 1) when the housing shells 132 and 134 are mated together. As will be discussed in greater detail below, the receptacle connector 100 includes at least one spring tab 122 that is oriented to project, for example, from the inner surface 133 toward the mating end 106 (FIG. 1). The spring tab 122 may be integrally formed with the housing 102 or, more specifically, the housing shells 132 and 134. Furthermore, the housing 102 may include one or more ridge portions (discussed below) that are oriented to project from the interior surface 114. When the receptacle connector 100 is fully assembled, the contact module 120 is held between the ridge portion and the spring tab 122 such that the contact module 120 is held within the cavity 104 (FIG. 1). Each spring tab 122 may be configured to flex toward the interior surface 114 when the contact module 120 is being inserted into the cavity 104 or the corresponding shell and flex away from the interior surface 114 into a retained position against the contact module 120 when the contact module 120 engages the corresponding ridge portion.

As used herein, the term "integrally formed," with respect to the spring tab(s) 122 means that the spring tab 122 is formed with the housing 102. For example, the housing shells 132 and 134 may be made through an injection molding process where a resin, such as a resin that includes polyarylether ketone (PAEK), is injected into a mold. As such, the spring tab(s) 122 and other features of the corresponding shells may be made altogether during a common process. In an alternative embodiment, the housing 102 is made entirely from one piece (i.e., not separate shells as shown in the figures) that includes the spring tab(s) 122. In some embodiments, the housing shells 132 and 134 are made from a composite material, which may or may not include a material such as PAEK. Other materials, including a variety of thermoplastics (e.g., PAEK, polyetherimide), metal, or metal alloys (e.g., aluminum), may be used. The material may be conductive, non-conductive, or made to be conductive in predetermined parts. For example, conductive fibers may be dispersed within the resin and injected into certain areas of a mold. Also, the housing 102 is not limited to being manufactured through molding processes, but may also be formed through other processes, such as casting, machining, or stamping.

The term "retained", when used with reference to a component that is engaged or coupled with another component or feature, means that the component is coupled in such a way that the motion or movement of the component is restricted by the other component(s) or features. As such, a component retained between other components and/or features may be able to move slightly, but the range of movement is limited by the other component(s) or features. This range of movement is typically provided to allow compliance during mating and unmating. However, motion and location are typically controlled when connectors are fully mated. In some embodiments, when the receptacle connector 100 is fully constructed the component may be held in a stationary position as if the receptacle connector 100 was one unit.

Also shown in FIG. 2, the contact module 120 includes a dielectric material and is shaped to be held within the cavity 104 when the receptacle connector 100 is fully assembled. The contact module 120 is configured to hold an array of mating contacts 137 in predetermined positions. Although the mating contacts 137 shown in FIG. 2 are pin contacts projecting outward from the contact module 120, embodiments described herein are not intended to be limited as such. For example, alternative embodiments may include a contact module that includes sockets or holes holding a mating or socket contact therein. Furthermore, in other embodiments, the contact module 120 only holds one mating contact. In addition, the receptacle connector 100 may hold more than one contact module 120.

Figure 4:
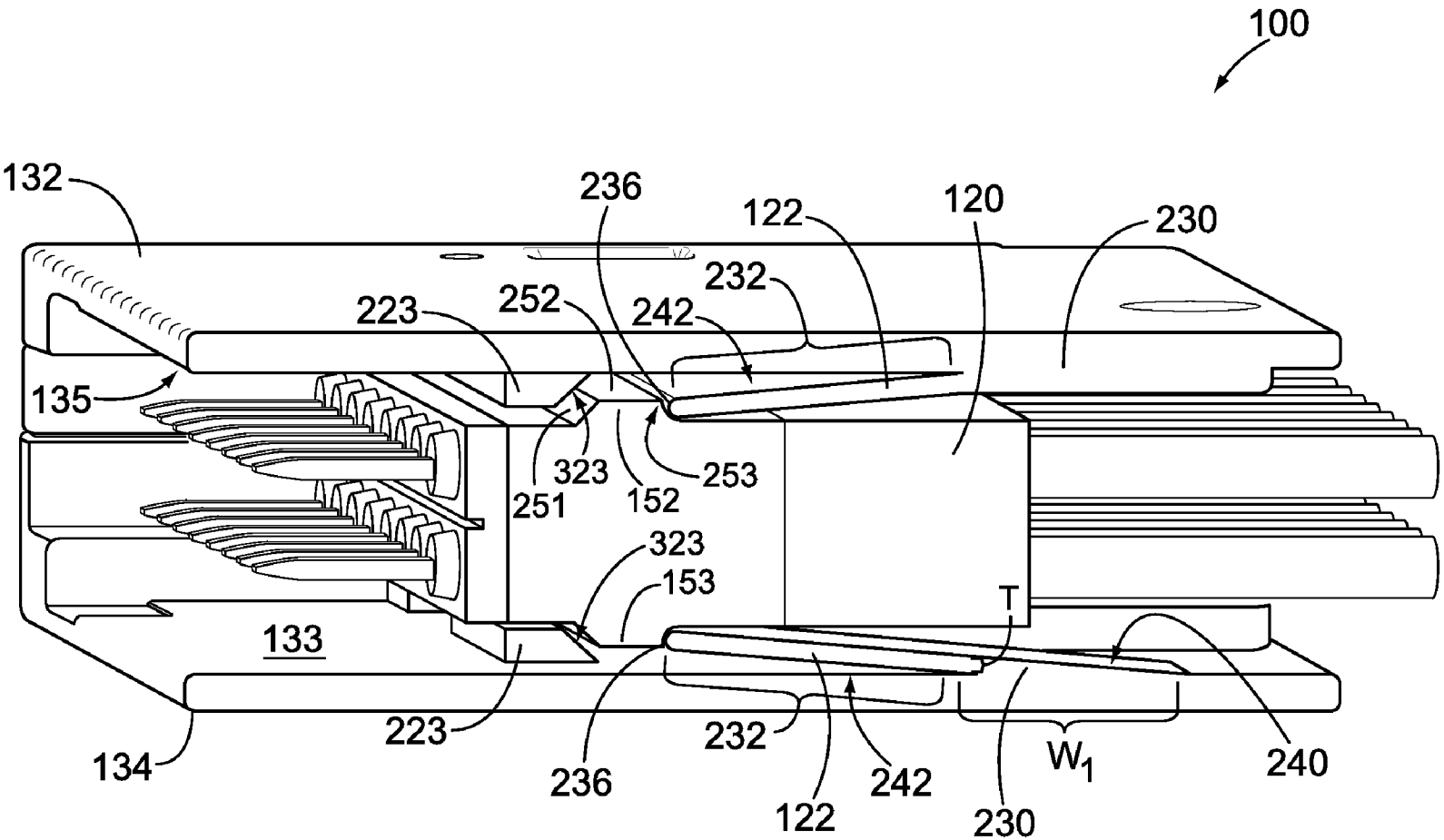
FIG. 4 is a cross-sectional perspective view of the connector in FIG. 1 illustrating spring tabs in a retained position.

As shown, each conductor or cable 125 is connected to a corresponding mating contact 137. The mating contacts 137 may be inserted through apertures (not shown) proximate to the loading end 108 (FIG. 1) of the receptacle connector 100 and project from the contact module 120 proximate to the mating end 106. The contact module 120 has an outer surface 121 and includes projections 150-153 (the projection 153 is shown in FIG. 4) that extend along the longitudinal axis 192 (FIG. 1). The contact module 120 may include other projections not shown. As will be discussed in greater detail below, the projections 150, 152, and 153 are configured to engage and be positioned between a corresponding ridge portion and spring tab 122.

Figure 3:
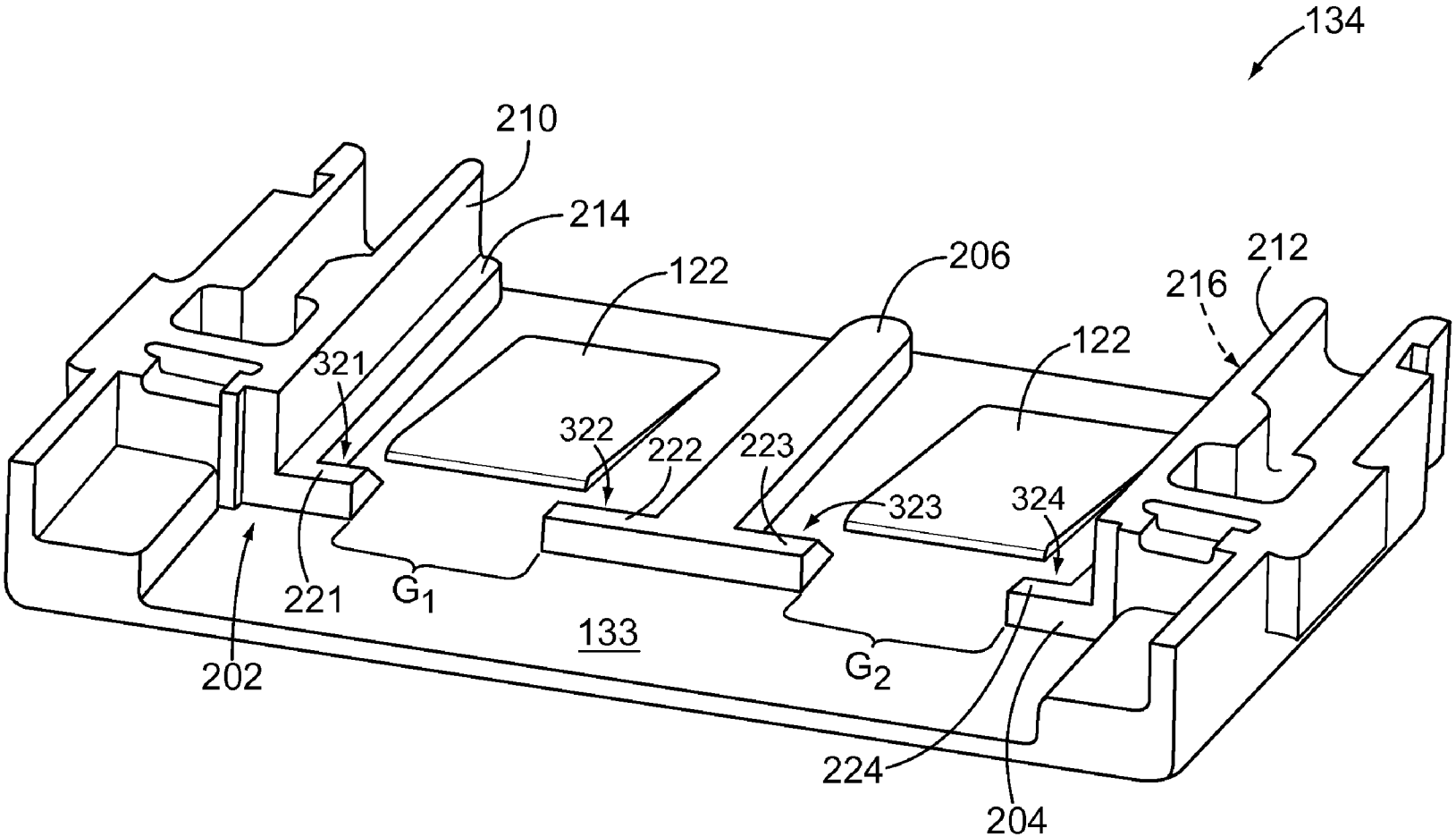
FIG. 3 is a perspective view of a shell that may be used to construct the receptacle connector in FIG. 1.

FIG. 3 is an enlarged perspective view of the housing shell 134. Although not shown, the following description of the housing shell 134 may similarly be applied to the housing shell 132 (FIG. 2). However, the housing shells 132 and 134 are not required to be identical. For example, one housing shell may have one or more spring tabs 122 while the other housing shell has none, or the housing shells 132 and 134 may have an unequal number of spring tab(s) 122. In such embodiments, the projections of the contact module 120 (FIG. 2) and other features of the housing 102 would be configured accordingly so that the contact module 120 maybe held within the housing 102 as described herein.

As shown, the housing shell 134 includes several features that are configured to facilitate holding or loading the contact module 120. For example, the housing shell 134 includes a pair of opposing corner portions 202 and 204 and a platform 206 positioned between the corner portions 202 and 204. The corner portions 202 and 204 include a sidewall 210 and 212, respectively, and a ledge 214 and 216, respectively, that join each other at a corner. The platform 206 and the ledges 214 and 216 extend between the mating and loading ends 106 and 108 (FIG. 1) along the central axis 190 (FIG. 1) and have corresponding surfaces that may be co-planar with respect to each other. The platform 206 and corner portions 202 and 204 are configured to direct the contact module 120 when being inserted into the cavity 104 (FIG. 1) and to facilitate supporting the contact module 120 therein. Also shown, each corner portion 202 and 204 also includes a ridge portion 221 and 224, respectively, that projects away from the corresponding sidewall along the longitudinal axis 192 (FIG. 1). The platform 206 may also have a pair of ridge portions 222 and 223 that project away from each other toward corresponding sidewalls 210 and 212, respectively. Furthermore, each ridge portion 221-224 has a ridge surface 321-324, respectively. The shape of each ridge surface 321-324 may be configured to engage a predetermined portion of the contact module 120 as discussed below. In the illustrated embodiment, the ridge surfaces 321-324 are configured to engage one or more of the projections 150-153.

The ridge portions 221-224 and the spring tabs 122 cooperate with each other to hold or prevent the contact module 120 from moving from a predetermined position within the cavity 104. In the illustrated embodiment, the ridge portions 221-224 are aligned with respect to each other along the longitudinal axis 192. However, in alternative embodiments, the ridge portions 221-224 are not aligned with each other, but may have, for example, staggered or alternating positions. Also shown, the spring tabs 122 and the ridge portions 221-224 project from the inner surface 133. Furthermore, the ridge portions 221 and 222 are separated from each other by a gap $G_1$, and the ridge portions 223 and 224 are separated from each other by a gap $G_2$. In an alternative embodiment, a single ridge portion may extend continuously across the inner surface 133 from the corner portion 202 to the platform 206 and to the corner portion 204 (i.e., there are no gaps between the ridge portions).

FIG. 4 is a cross-sectional perspective view of the receptacle connector 100 illustrating the spring tabs 122 of the housing shells 132 and 134 in an engaged or retained position with the contact module 120. In the illustrated embodiment, the housing shells 132 and 134 each include a pair of spring tabs 122 that extend in a common direction from the corresponding inner surface 133 and 135, respectively. For example, the spring tabs 122 may extend toward the mating end 106 at a non-orthogonal angle with respect to the central axis 190. Each spring tab 122 may oppose another spring tab 122 of die other housing shell across the cavity 104. Furthermore, each spring tab 122 has a base portion 230 extending from the corresponding inner surface and forming a tab body 232 therefrom. As shown, the tab body 232 has a thickness T and the base portion 230 has a width $W_1$ on the inner surface 133 along the central axis 190. The thickness T may be substantially constant throughout the tab body 232. In the illustrated embodiment, the width $W_1$ is substantially greater than the thickness T. As such, the spring tab 122 may provide a greater resilient force against the contact module 120 and may also prevent deformation of the spring tab 122 when the spring tab 122 is in the retained position.

Furthermore, the spring tab 122 has an anterior surface 240 that faces the contact module 120 and a posterior surface 242 that faces the corresponding inner surface. In the illustrated embodiment, the anterior and posterior surfaces 240 and 242 are planar and without any bends, curves, or additional features that project therefrom. However, alternative embodiments may be configured as desired to facilitate holding the contact module 120 within the housing 102. Also shown, the anterior and posterior surfaces 240 and 242 join each other at a distal tip 236 of the tab body 232. The distal tip 236 may be shaped and configured to engage the corresponding projection of the contact module 120 when in the retained position. For example, the distal tip 236 may be rounded or, alternatively, shaped with a sharp corner or edge.

Also shown in FIG. 4, the projections 152 and 153 extend from the outer surface 121 (FIG. 2) of the contact module 120 and each includes a mating surface 251, a top surface 252, and a back surface 253. As shown, in the retained position, the projection 152 is held between the spring tab 122 and the ridge portion 223 of the housing shell 132, and the projection 153 is held between the spring tab 122 and the ridge portion 223 of the housing shell 134. In the illustrated embodiment, the projections 152 and 153 have a size and shape that are configured to fit within the space between the distal tip 236 and the corresponding ridge surface.

In an alternative embodiment, the contact module 120 does not include projections, but may include indentations or grooves that are configured to engage the distal tip 236 of the spring tabs 122.

When the contact module 120 is inserted into the cavity 104, the mating surface 251 and/or the top surface 252 of each projection 152 and 153 engages the anterior surface 240 of the corresponding spring tab 122. The spring tab 122 flexes away from the contact module 120 and toward the inner surface 133. When the top surface 252 of the projections 152 and 153 clears the distal tip 236 of the corresponding spring tab 122, the spring tab 122 resiliently flexes away from the inner surface 133 toward the contact module 120 against the outer surface 121. In the retained position, the distal tip 236 presses against the corresponding projection. As such, the contact module 120 is held within the cavity 104 of the receptacle connector 100. In order to remove tile contact module 120, a tool (not shown) may be inserted into the cavity 104 through the loading end 108 to depress the spring tab(s) 122 toward the respective inner surfaces 133 and 135.

Alternatively, the contact module 120 may be placed against the inner surface 133 of the housing shell 132 such that the projection 152 is between the distal tip 236 and the ridge portion 223. The housing shell 134 may then be applied or sandwiched over the contact module 120 such that the housing shells 132 and 134 mate with each other along the interfaces 136 and 138.

Figure 5:
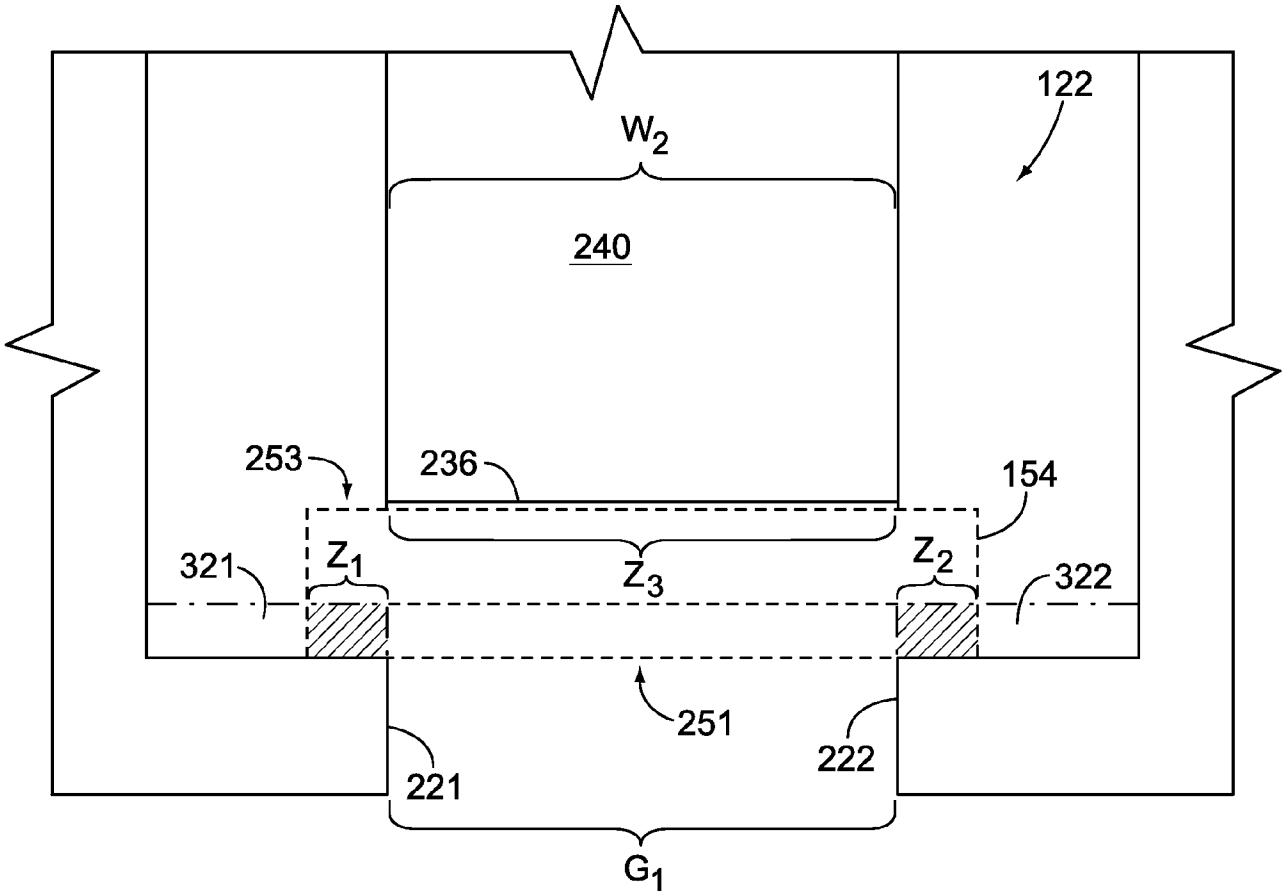
FIG. 5 is a cross-sectional view of the connector taken along the line 5-5 shown in FIG. 1.

FIG. 5 is a cross-sectional view of a portion of the receptacle connector 100 taken along the line 5-5 shown in FIG. 1. FIG. 5 shows the projection 154 being retained between the corresponding spring tab 122 and ridge portions 221 and 222. (For illustrative purposes, the contact module 120 and the mating contacts 137 are not shown.) In the illustrated embodiment, the spring tab 122 has a width $W_2$ that may be substantially constant throughout and approximately equal to the gap $G_1$. Alternatively, the width $W_2$ may be greater than or less than the gap $G_1$. As shown, when the spring tab 122 is in the retained position, the projection 154 is engaged with the housing 102 (FIG. 1) along multiple contact zones $Z_1$-$Z_3$. The mating surface 251 is engaged with the ridge surfaces 321 and 322 along contact zones $Z_1$ and $Z_2$, respectively. The back surface 253 of the projection 154 is engaged with the distal tip 236 of the spring tab 122 along a contact zone $Z_3$.

When in the retained position, the spring tab 122 provides a force $F_A$ against the contact zone $Z_3$ in a direction toward the mating end 106 (FIG. 1). The ridge surfaces 321 and 322 provide retention of the contact module 120 in contact zones $Z_1$ and $Z_2$, respectively, in a direction toward the loading end 108 (FIG. 1). The contact zones $Z_1$ and $Z_2$ are positioned on either side of the contact zone $Z_3$. The cooperation of the spring tab 122 and the ridge portions 221 and 222 facilitate minimization of the axial movement along the central axis 190 and also rotational movement about the lateral axis 194 before the receptacle connector 100 is fully assembled and in operation.

Figure 6:
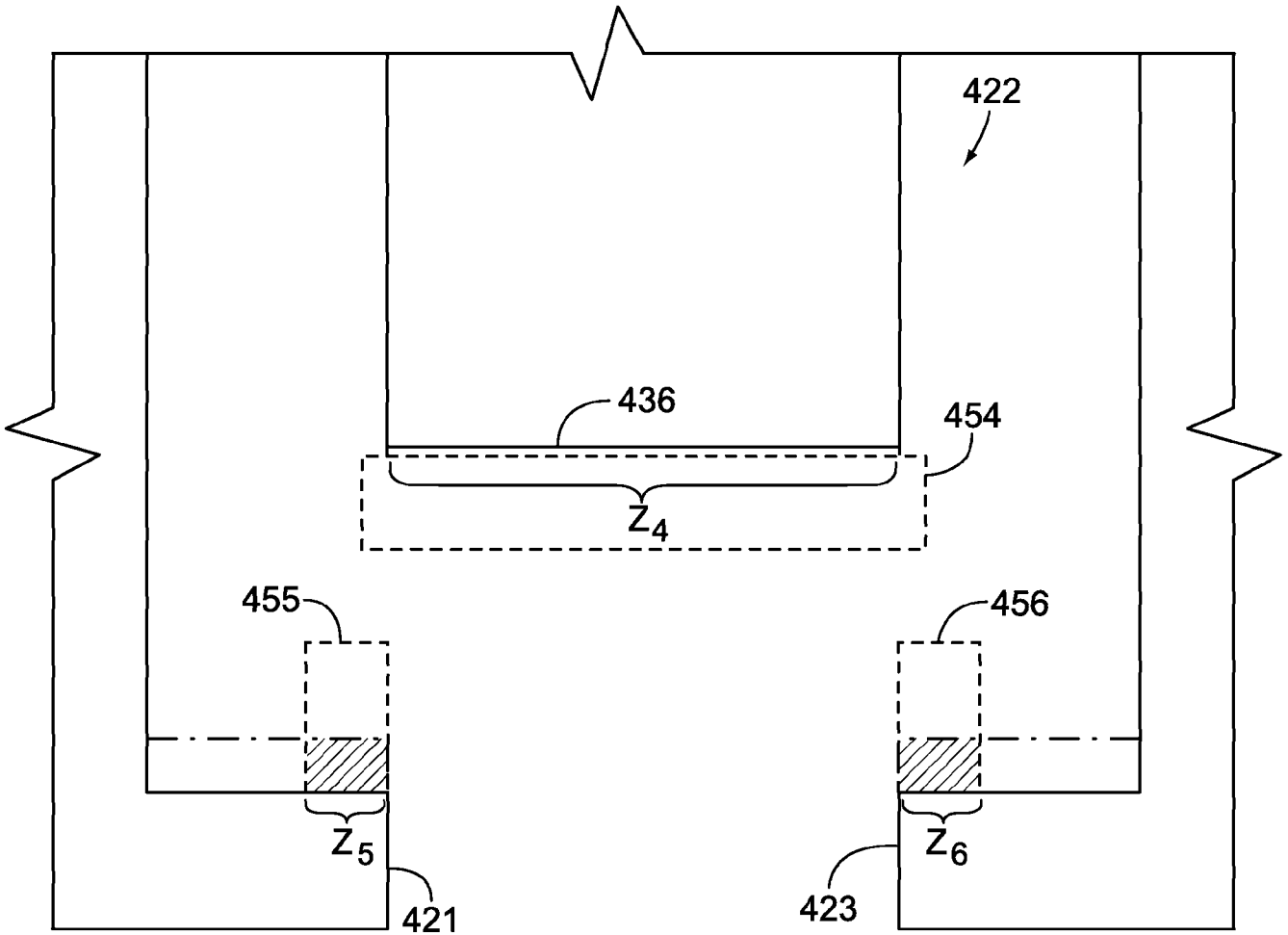
FIG. 6 is a cross-sectional view of a receptacle connector formed in accordance with an alternative embodiment.

FIG. 6 is a cross-sectional view of a portion of another receptacle connector (not shown) formed in accordance with an alternative embodiment. As shown, the alternative receptacle connector may include separate projections 454-456 that project outwardly from a contact module (not shown) where each projection engages another feature at a corresponding contact zone $Z_4$-$Z_6$. As shown, the projections 454-456 are not aligned with each other. Specifically, the projection 454 engages a spring tab 422 at the contact zone $Z_4$, the projection 455 engages a ridge portion 421 at the contact zone $Z_5$, and the projection 456 engages a ridge portion 423 at the contact zone $Z_6$. Similar to the spring tab 122 and the contact module 120 discussed with reference to FIG. 5, the spring tab 422 and the ridge portions 421 and 423 are configured to engage the projections 454-456, respectively. When the projections 455 and 456 engage the ridge portions 421 and 423, respectively, a distal tip 436 of the spring tab 422 clears the projection 454 and resiliently flexes into a retained position against the projection 454 at the contact zone $Z_4$.

Figure 7:
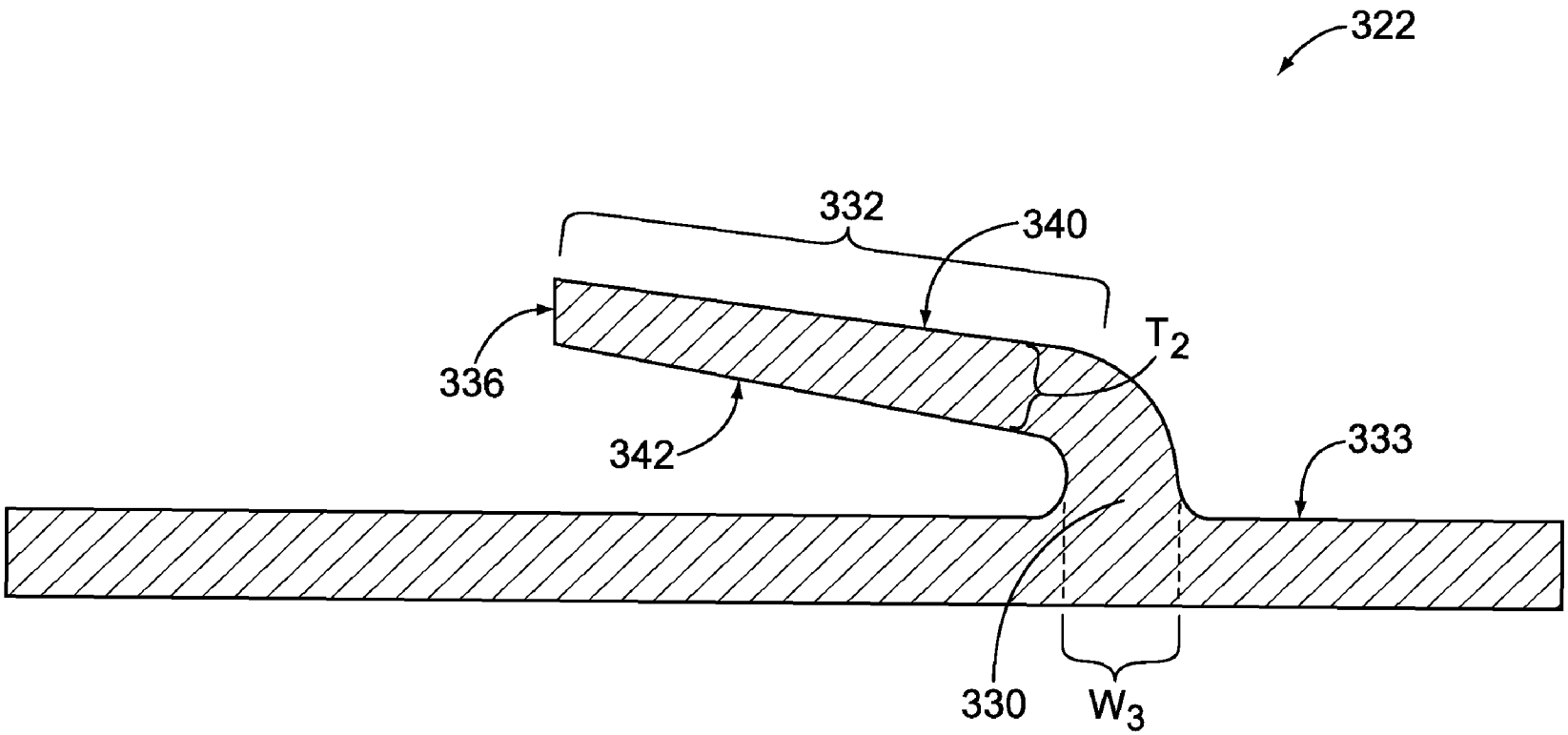
FIG. 7 is a cross-sectional view of a spring tab that may be used with a connector formed in accordance with an alternative embodiment.

FIG. 7 is a cross-sectional view of a spring tab 322 that may be used with a connector (not shown) formed in accordance with an alternative embodiment. The connector may have similar features as the receptacle connector 100 (FIG. 1) described above. The spring tab 322 has a base portion 330 extending from an inner surface 333 and forming a tab body 332 therefrom. As shown, the tab body 332 has a thickness $T_2$ and the base portion 330 has a width $W_3$ on the inner surface 333. In the illustrated embodiment, the width $W_3$ is substantially equal to the thickness $T_2$ of the tab body 332. Furthermore, the spring tab 322 has an anterior surface 340 that faces a contact module (not shown) when the contact module is inserted into the connector. The spring tab 322 also has a posterior surface 342 that faces the inner surface 333. Also shown, the anterior and posterior surfaces 340 and 342 join each other at a distal tip 336 of the tab body 332. The distal tip 336 may be shaped and configured to engage a corresponding projection of the contact module when in the retained position. For example, the distal tip 336 is substantially planar.

Also shown in FIG. 7, the base portion 330 may project away and substantially perpendicular to the inner surface 333 and then curve toward one end. As such, the spring tab 322 may form a curved or rounded corner where the spring tab 322 joins the inner surface 333.

The receptacle connector 100 may be configured for many applications, such as high-speed telecommunications equipment, various classes of servers, and data storage and transport devices. The receptacle connector 100 may perform at high speeds and maintain signal integrity while withstanding vibrations and shock that may be experienced during, for example, aerospace or military operations. However, embodiments described herein are not limited to applications for extreme environments, but may also be used in other environments, such as in an office or home. The preceding description of the receptacle connector 100 is provided for illustrative purposes only, rather than limitation, and the illustrated embodiment is but one application that may be used with the features and mechanisms described herein.

Furthermore, although the preceding description was directed toward the receptacle connector 100, the features of the housing 102 and the contact module 120 may similarly be applied to a plug connector. For example, instead of having the mating contacts 137 project through and outward from the contact module 120, a plug connector may have a contact module that includes holes or sockets for receiving mating contacts from a receptacle connector. The sockets may also have mating contacts embedded therein that are configured to engage the mating contacts of the receptacle connector when the plug and receptacle connectors are mated. As such, embodiments described herein are not limited to receptacle connectors.

In addition, alternative embodiments may have more than one contact module 120 within the housing 102. Each contact module 120 may hold one or more mating contacts 137. The contact modules 120 may be held in position by one or more spring tabs 122.

Also, while the illustrated embodiment described above is designed for a specific orientation when mounted or mated with another connector, alternative embodiments may have other configurations. As such, the terms front, back (or rear), top, bottom, upper, lower, upward, downward, inward and the like are relative and based on the orientation of the illustrated embodiment, and are not intended to be restrictive.

Thus, it is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. For example, generally a "connector," as may be used in the following claims, may either be a plug connector or a receptacle connector, such as the receptacle connector 100 described herein, unless specified otherwise. Furthermore, a "mating contact," as may be used in the following claims, may either be a pin contact or a socket contact, unless otherwise specified. Also, a mating contact, including a pin contact and socket contact, may be an electrical contact or a terminus for an optical fiber.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector configured to hold a contact module, the connector comprising:

a housing having an interior surface defining a cavity that extends between first and second ends of the housing, the cavity being configured to receive and hold the contact module therein;

a spring tab located in the cavity and oriented to project from the interior surface toward the first end of the housing, the spring tab being integrally formed with the housing and being configured to flex toward the interior surface when the contact module is being inserted and flex away from the interior surface into a retained position against the contact module; and a ridge portion located in the cavity and oriented to project from the interior surface, the contact module being retained between the ridge portion and the spring tab.

2. The connector in accordance with claim 1 wherein the ridge portion includes a pair of ridge portions aligned with each other along a common axis, the pair of ridge portions being separated by a gap, the spring tab having a distal tip that engages the contact module and faces the gap.

3. The connector in accordance with claim 1 wherein the housing comprises a pair of shells mated together along at least one interface.

4. The connector in accordance with claim 1 wherein the spring tab includes a distal tip that engages the contact module held within the housing.

5. The connector in accordance with claim 1 wherein the contact module includes a projection, the ridge portion and the spring contact engaging and retaining the projection therebetween.

6. The connector in accordance with claim 1 wherein the spring tab includes a pair of spring tabs opposite from each other across the cavity, the spring tabs engaging the contact module held within the housing.

7. The connector in accordance with claim 1 wherein the spring tab includes a pair of spring tabs extending from a common surface in a common direction, the spring tabs engaging the contact module held within the housing.

8. The connector in accordance with claim 1 wherein the housing is at least partially formed from polyarylether ketone (PAEK).

9. The connector in accordance with claim 1 wherein the spring tab has a base portion extending from the interior surface and a tab body extending therefrom, the spring tab body having a thickness and the base portion having a width that is greater than the thickness.

10. A connector comprising:

a contact module configured to hold at least one mating contact connected to a corresponding conductor or cable;

a housing having an interior surface defining a cavity that extends between first and second ends of the housing, the cavity being configured to receive and hold the contact module therein;

a spring tab located in the cavity and oriented to project from the interior surface toward the first end of the housing, the spring tab being integrally formed with the housing and being configured to flex toward the interior surface when the contact module is being inserted and flex away from the interior surface into a retained position against the contact module; and a ridge portion located in the cavity and oriented to project from the interior surface, the contact module being retained between the ridge portion and the spring tab.

11. The connector in accordance with claim 10 wherein the ridge portion includes a pair of ridge portions aligned with each other along a common axis, the pair of ridge portions being separated by a gap, the spring tab having a distal tip that engages the contact module and faces the gap.

12. The connector in accordance with claim 10 wherein the housing comprises a pair of shells mated together along at least one interface.

13. The connector in accordance with claim 10 wherein the contact module includes a projection, the ridge portion and the spring contact engaging and retaining the projection therebetween.

14. The connector in accordance with claim 10 wherein the spring tab includes a pair of spring tabs opposite from each other across the cavity, the spring tabs engaging the contact module held within the housing.

15. The connector in accordance with claim 10 wherein the spring tab includes a plurality of spring tabs extending from a common surface in a common direction, the spring tabs engaging the contact module held within the housing.

16. The connector in accordance with claim 10 wherein the housing is at least partially formed from polyarylether ketone (PAEK).

17. The connector in accordance with claim 10 wherein the contact module is configured to hold at least one mating contact, the contact module is configured to engage a corresponding mating socket contact of a mating connector.

18. The connector in accordance with claim 10 wherein the contact module is configured to hold at least one mating socket contact, the contact module is configured to engage a corresponding mating pin contact of a mating connector.

* * * * *